US008794005B2

(12) United States Patent
Rudrapatna et al.

(10) Patent No.: US 8,794,005 B2
(45) Date of Patent: Aug. 5, 2014

(54) COMBUSTOR CONSTRUCTION

(75) Inventors: Nagaraja Rudrapatna, Mississauga (CA); Oleg Morenko, Oakville (CA); Bhawan B. Patel, Mississauga (CA)

(73) Assignee: Pratt & Whitney Canada Corp., Longueuil, CA (US)

( * ) Notice: Subject to any disclaimer, the term of this patent is extended or adjusted under 35 U.S.C. 154(b) by 789 days.

(21) Appl. No.: 11/642,735

(22) Filed: Dec. 21, 2006

(65) Prior Publication Data

US 2008/0148738 A1 Jun. 26, 2008

(51) Int. Cl.
*F02C 1/00* (2006.01)

(52) U.S. Cl.
USPC ..... 60/752; 60/754; 60/756

(58) Field of Classification Search
USPC ..... 60/758, 760, 752–757, 759, 751
See application file for complete search history.

(56) References Cited

U.S. PATENT DOCUMENTS

| | | | | | |
|---|---|---|---|---|---|
| 3,589,128 | A | * | 6/1971 | Sweet | 60/757 |
| 3,844,116 | A | * | 10/1974 | Matto | 60/800 |
| 3,991,562 | A | * | 11/1976 | Nelson et al. | 60/757 |
| 4,232,527 | A | * | 11/1980 | Reider | 60/754 |
| 4,236,378 | A | * | 12/1980 | Vogt | 60/757 |
| 4,469,395 | A | * | 9/1984 | Bennett | 439/894 |
| 4,475,344 | A | * | 10/1984 | Mumford et al. | 60/757 |
| 4,549,402 | A | * | 10/1985 | Saintsbury et al. | 60/738 |
| 4,901,522 | A | * | 2/1990 | Commaret et al. | 60/800 |
| 5,165,226 | A | | 11/1992 | Newton et al. | |
| 5,237,813 | A | * | 8/1993 | Harris et al. | 60/804 |
| 6,079,199 | A | * | 6/2000 | McCaldon et al. | 60/800 |
| 6,155,056 | A | * | 12/2000 | Sampath et al. | 60/756 |
| 6,265,022 | B1 | * | 7/2001 | Fernihough et al. | 427/142 |
| 6,269,628 | B1 | * | 8/2001 | Gates | 60/804 |
| 6,497,105 | B1 | | 12/2002 | Stastny et al. | |
| 2006/0042263 | A1 | | 3/2006 | Patel et al. | |
| 2006/0053797 | A1 | | 3/2006 | Stastny et al. | |
| 2006/0101828 | A1 | | 5/2006 | Patel et al. | |
| 2006/0277921 | A1 | | 12/2006 | Patel et al. | |

OTHER PUBLICATIONS

U.S. Appl. No. 11/393,758, Pratt & Whitney Canada Corp.
U.S. Appl. No. 11/175,046, Pratt & Whitney Canada Corp.
U.S. Appl. No. 11/149,264, Pratt & Whitney Canada Corp.
Canadian Intellectual Property Office; Examiner's Requisition dated Jan. 25, 2013.
Canadian Intellectual Property Office; Response to Examiner's Requisition dated Jul. 24, 2013.
Canadian Intellectual Property Office; Examiner's Requisition dated Dec. 16, 2013.

* cited by examiner

*Primary Examiner* — William H Rodriguez
*Assistant Examiner* — Arun Goyal
(74) *Attorney, Agent, or Firm* — Norton Rose Fulbright Canada LLP

(57) ABSTRACT

A reverse flow combustor for a gas turbine engine having an outer combustor liner and an inner combustor liner defining an annular combustion chamber, and a compound-angle frustoconical portion in the outer liner having a first and second conical slopes towards an engine centerline.

10 Claims, 4 Drawing Sheets

COMBUSTOR CONSTRUCTION

TECHNICAL FIELD

The invention relates to a gas turbine combustor, and more particularly, to the construction of such a combustor.

BACKGROUND OF THE ART

A reverse flow combustor for a gas turbine engine comprises an annular bulkhead or combustor dome in which is mounted a number of fuel nozzles. From the dome, inside and outside combustor liner walls extend to contain the combustion gases which reverse direction and exit the combustion zone via a large/outer exit duct and a small/inner exit duct towards the high and low pressure turbine zones. With all combustors, the space inside the combustor, or combustion volume, is designed to provide the desired combustion characteristics, while the space outside the combustor, between the combustor and surrounding engine case, is designed to permit the desired airflow around the combustor. However, the constraints of the engine configuration do not always permit both to be individually optimized, and consequently trade-offs are some time necessary. Nonetheless, there is a desire to improve the overall efficiency and performance of combustors, while ever reducing costs and weight.

SUMMARY

In one aspect, provided is a reverse flow combustor for a gas turbine engine comprising an outer liner and an inner liner cooperating to define an annular reverse flow combustion chamber having a cylindrical head portion, the outer liner having a compound-angle frustoconical portion extending downstream from the cylindrical head portion relative to airflow inside the combustor, the compound-angle frustoconical portion including a first frustoconical portion extending from the cylindrical head portion and having a first conical slope towards an engine centreline and a second frustoconical portion extending from the first frustoconical portion and having a second conical slope towards the engine centreline, the first conical slope being greater than the second conical slope.

In another aspect, provided is a gas turbine engine comprising a case housing compressor, combustor and turbine stages in serial flow communication, the compressor stage including a centrifugal impeller with a diffuser stage having diffuser pipes, the combustor stage have a reverse flow combustion liner with an outer liner having a compound-angle frustoconical portion extending downstream from the cylindrical head portion relative to airflow inside the combustor, a first frustoconical section of the compound-angle frustoconical portion extending from the cylindrical head portion and having a first conical slope towards an engine centreline, a second frustoconical section of the compound-angle frustoconical portion extending from the first frustoconical section and having a second conical slope towards the engine centreline, the first conical slope being greater than the second conical slope.

DESCRIPTION OF THE DRAWINGS

The invention is illustrated by way of example in the accompanying drawings, in which.

Further details will be apparent from the detailed description included below.

DETAILED DESCRIPTION OF PREFERRED EMBODIMENTS

Figure 1:
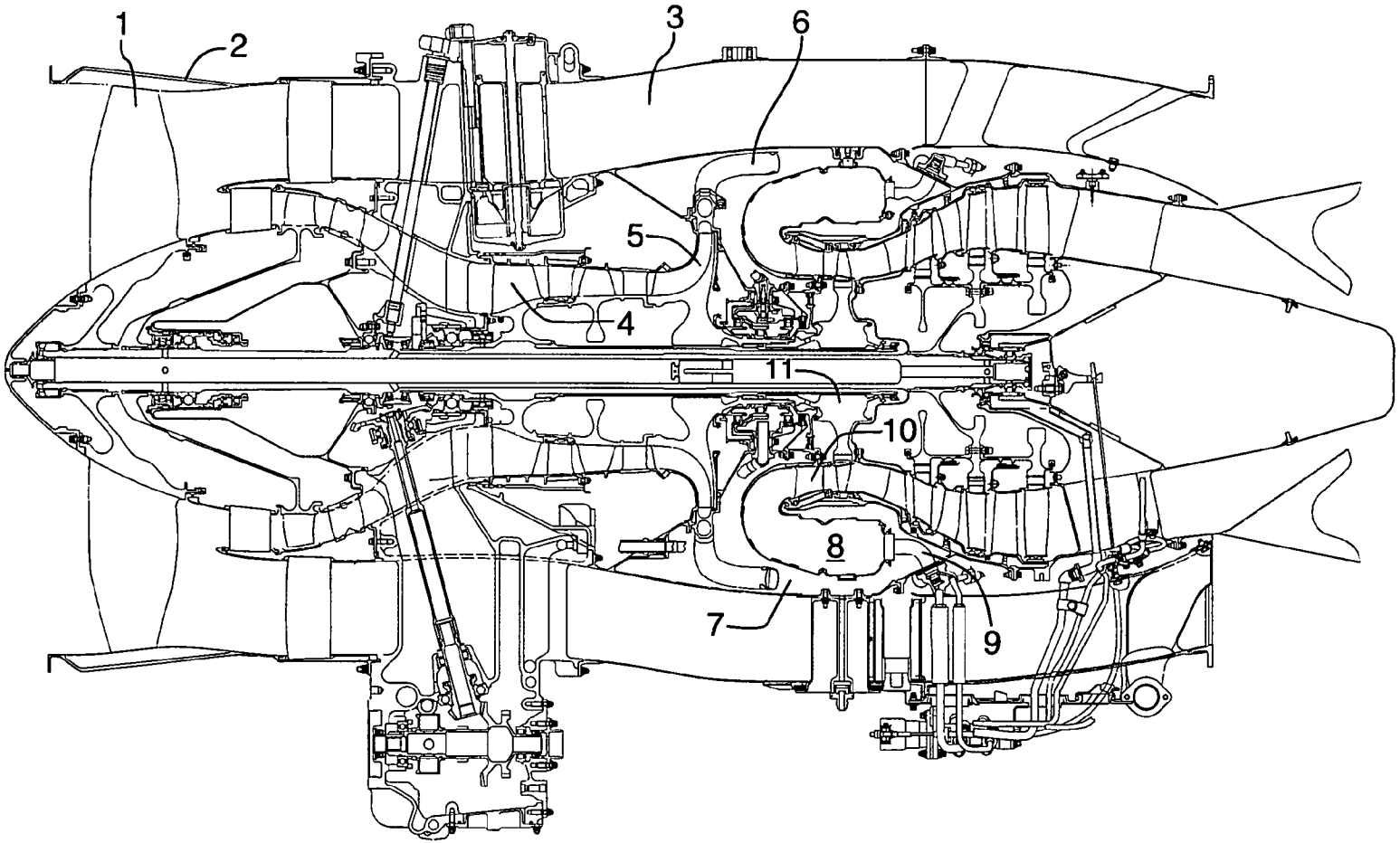
FIG.1 (Prior Art)
FIG. 1 is an axial cross-sectional view through a prior art gas turbine engine showing the various components that are assembled to produce an engine.

FIG. 1 shows an axial cross-section through a turbofan gas turbine engine. It will be understood however that the invention is applicable to any type of gas turbine engine with an annular reverse flow combustor, such as a turboshaft engine, a turboprop engine, or auxiliary power unit. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust.

Figure 2:
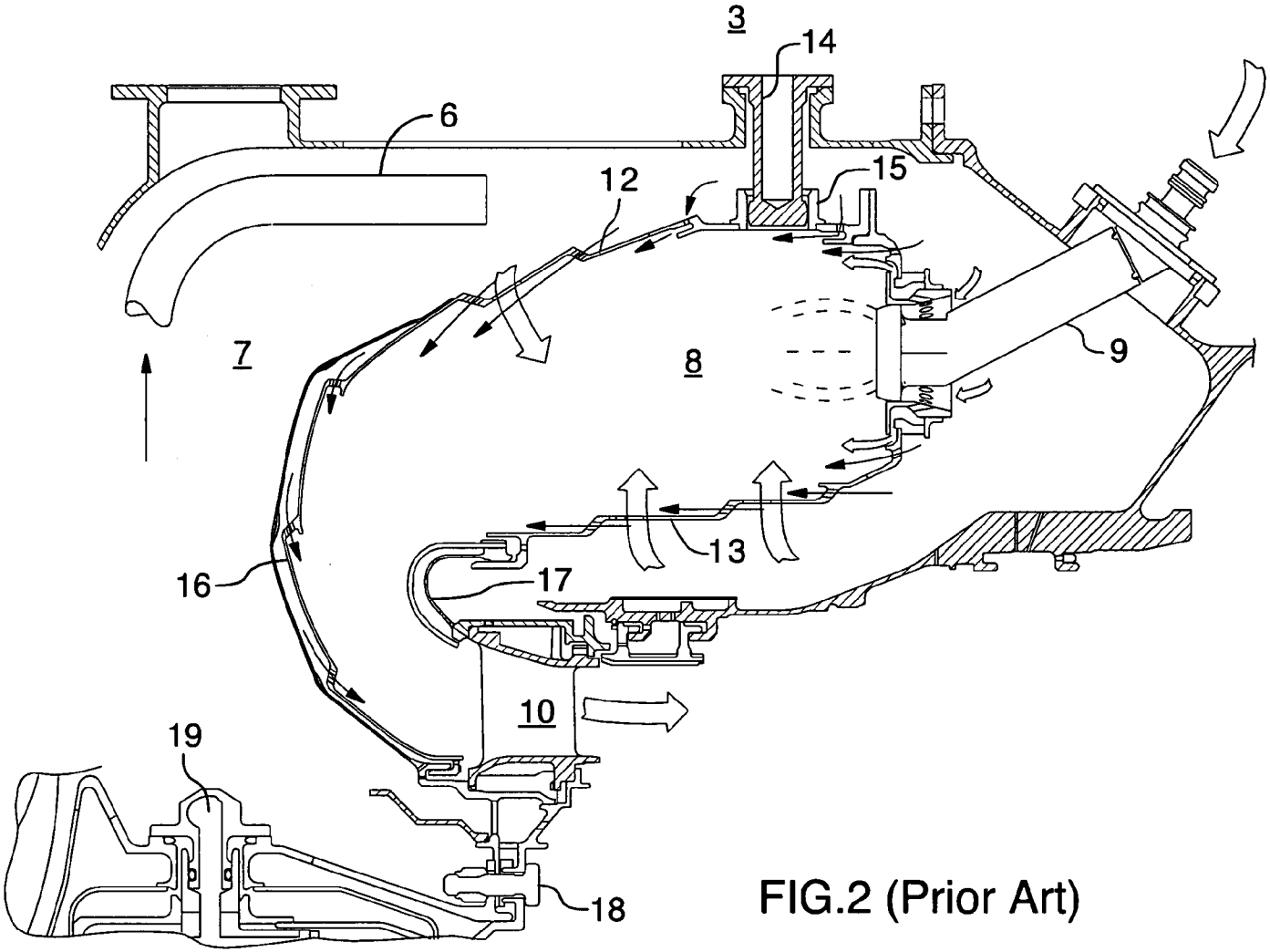
FIG.2 (Prior Art)
FIG. 2 is a detailed axial cross-section through a prior art combustor.

FIG. 2 shows a detailed axial cross-section through a prior art combustor 8. The outer combustor liner 12 and the inner combustor liner 13 define the annular combustion chamber into which fuel-air mixture is injected and ignited. The outer combustor liner 12 is axially restrained with a plurality of support pins 14. The ends of the support pins 14 radially slidingly engage a boss 15 in the outer combustor liner 12 which permits radial expansion and contraction while restraining the combustor 8 axially to an inside wall of the bypass duct 3.

The large exit duct 16 extends from the outer liner 12 and the small exit duct 17 extends from the inner liner 13 defining a reverse flow combustor duct that directs hot gases from a forward direction to a rearward direction passing the nozzle guide vanes 10.

Figure 3:
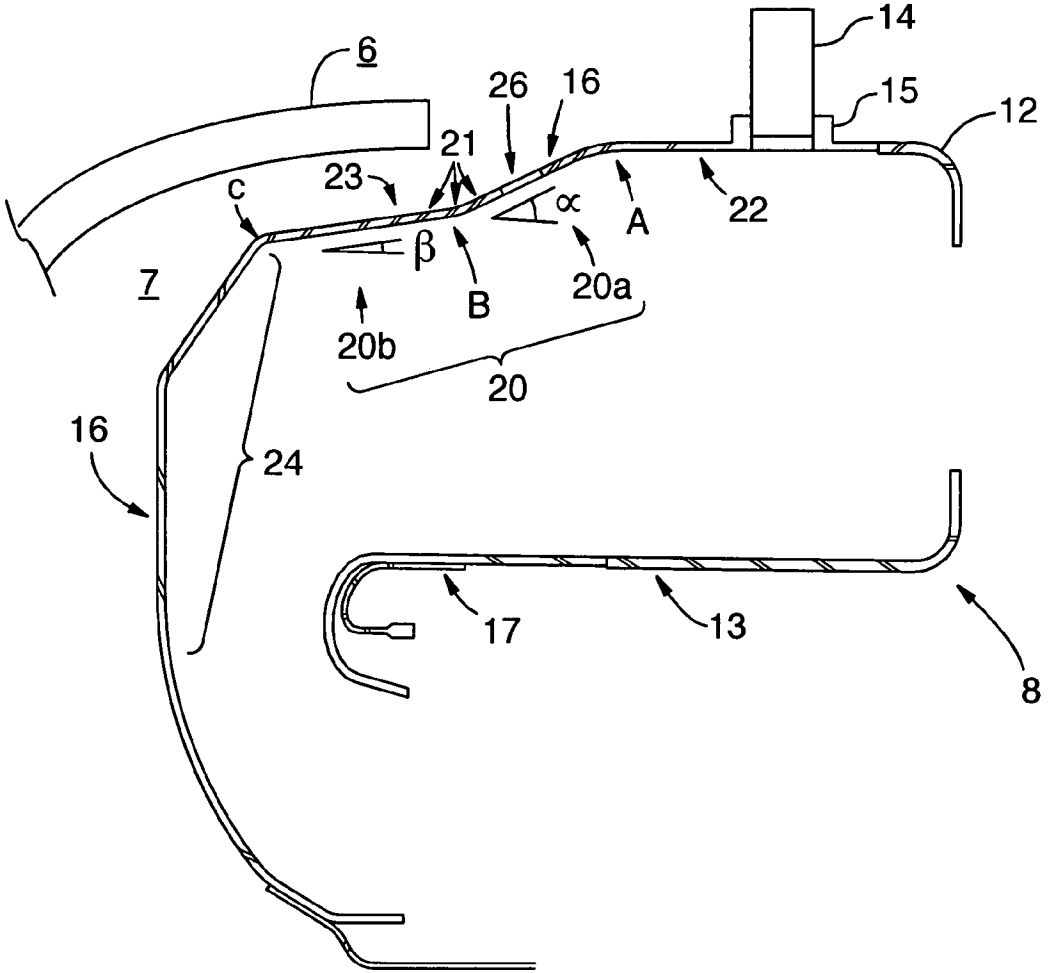
FIG. 3 is a detailed axial cross-section through a combustor in accordance with the invention.

FIG. 3 illustrates a combustor in accordance with the invention. The sheet metal combustor 8 has an outer liner 12 comprising a compound-angle frustoconical portion 20 extending the entire distance between an axially extending cylindrical head portion 22, in which the boss 15 is provided, and an entry portion 24 of the large exit duct 16. The cylindrical head portion 22 provides a desired primary combustion zone, but is located in a position more or less on the same radius as the exits of diffuser 6. Consequently, compound-angle frustoconical portion 20 is comprised of a first frustoconical portion 20*a*, having a first conical slope or angle $\alpha$, and a second frustoconical portion 20*b*, having a second conical slope angle $\beta$, where $\alpha>\beta$, preferably such $\beta$ is in the range of $0.7\alpha$ and $0.3\alpha$. Bends A, B, and C in the sheet metal of outer liner 12 define frustoconical portions 20, 20*a* and 20*b*. Bend B is located axially generally in alignment with, but preferably slightly downstream or, the diffuser outlet (relative to flow exiting the diffuser outlet). Bend B provides a hinge line between adjacent sections. The radius of bend B is preferably relatively "sharp"—i.e. with a radius of less than an inch. Bend C is provided between the LED 16 and the frustoconical portion 20. Bend A is provided between the cylindrical head section 22 and the frustoconical portion 20. A plurality of dilution holes 26 are provided in first frustoconical portion 20*a*, also downstream of the diffuser outlet.

Figure 4:
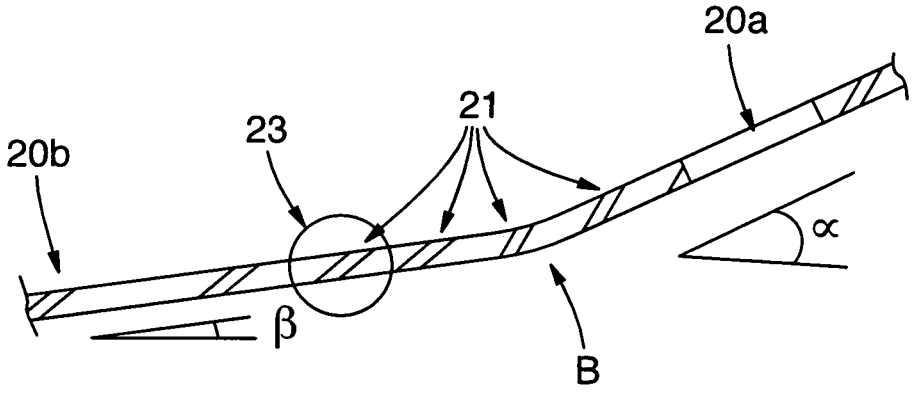
FIG. 4 is an enlarged view of a portion of FIG. 3.

A butt weld 23 (provided in the region indicated by the circle 23 in FIG. 4) is preferably provided, in any suitable manner, to join adjacent sections of the second frustoconical portion 20*b*. Effusion cooling holes 21 are provided through the outer liner, in particular, through the compound-angle frustoconical portion 20, and more particularly though the hinge line provided at bend B, and through the butt weld 23. Preferably two rows of holes are provided through the weld region.

By providing a compound-angle frustoconical portion 20, clearance is maintained between the outer liner 12 and the fishtails of diffuser 6 as the cylindrical head 22 is joined to the LED 16, thereby optimizing airflow around combustor 8 within plenum 7 while optimizing combustion volume inside the combustor. As mentioned above, this allows flow and combustor performance to be optimized. Effusion cooling augments the design by provided cooling where required to cool local hot spots in the kinked design. The sheet metal liner provides a low-cost, easy to manufacture and lightweight solution. The butt weld between adjacent sections of the liner and LED provide joining without unnecessary surface disruptions to obstruct airflow. Providing cooling through the weld region.

Although the above description relates to a specific preferred embodiment as presently contemplated by the inventors, it will be understood that the invention in its broad aspect includes mechanical and functional equivalents of the elements described herein.

We claim:

1. A reverse flow combustor for a gas turbine engine, the combustor comprising:

a cylindrical head portion;

an outer liner and an inner liner cooperating to define continuous outer and inner gas flow directing surfaces of an annular reverse flow combustion chamber for directing a hot combustion gas to change direction from a first direction adjacent the cylindrical head portion to a second reverse flow direction, wherein the hot combustion gas is directed to flow adjacent to the gas directing surfaces of the outer liner and the inner liner;

the outer liner having a compound-angle frustoconical portion, being defined as a frustum of a right circular cone, extending downstream from the cylindrical head portion relative to hot gas flow inside the combustor, the compound-angle frustoconical portion including a first frustoconical portion merging continuously with the cylindrical head portion and having a first conical non-zero slope towards an engine centreline and a second frustoconical portion merging continuously with the first frustoconical portion wherein the first frustoconical portion and the second frustoconical portion define at least part of the outer gas flow directing surface for directing the hot combustion gas, the second frustoconical portion having a second conical non-zero slope towards the engine centreline, the first conical slope being greater than the second conical slope and a ratio of the second conical slope to the first conical slope is in the range of 0.7 to 1 and 0.3 to 1;

wherein the first and second frustoconical portions meet at a circumferentially-extending hinge line having a bend radius of less than 1 inch and a plurality of effusion cooling holes are provided in the outer liner at the hinge line; and wherein the second frustoconical section comprises two portions of substantially identical conical slope and a butt weld interposed between and joining said two portions, the butt weld being adjacent the hinge line and a plurality of effusion cooling holes being provided through the butt weld.

2. A reverse flow combustor according to claim 1, wherein the holes through the hinge line location are angled relative to a surface of the liner in which the holes are provided.

3. A reverse flow combustor according to claim 1 wherein the first and second frustoconical portions meet angularly at a line adjacent an exit of at least one diffuser pipe of the engine.

4. A reverse flow combustor according to claim 3 wherein the conical slopes of the first and second frustoconical portions are selected to provide a desired clearance between the at least one diffuser pipe exit.

5. A reverse flow combustor according to claim 1 wherein the first frustoconical portion includes a plurality of dilution holes.

6. A gas turbine engine comprising:

a case housing a compressor stage, an annular reverse flow combustor and a turbine stage in serial flow communication;

the compressor stage including a centrifugal impeller and a diffuser stage having diffuser pipes;

the combustor comprising a cylindrical head portion, an outer liner and an inner liner cooperating to define continuous outer and inner gas flow directing surfaces of an annular reverse flow combustion chamber for directing a hot combustion gas to change direction from a first direction adjacent the cylindrical head portion to a second reverse flow direction, wherein the hot combustion gas is directed to flow adjacent to the gas directing surfaces of the outer liner and the inner liner;

the outer liner having a compound-angle frustoconical portion, being defined as a frustum of a right circular cone, extending downstream from the cylindrical head portion relative to hot gas flow inside the combustor, a first frustoconical section of the compound-angle frustoconical portion merging continuously with the cylindrical head portion and having a first conical non-zero slope towards an engine centreline, a second frustoconical section of the compound-angle frustoconical portion merging continuously with the first frustoconical section wherein the first frustoconical section and the second frustoconical section define at least part of the outer gas flow directing surface for directing the hot combustion gas, the second frustoconical section having a second non-zero conical slope towards the engine centreline, the first conical slope being greater than the second conical slope and a ratio of the second conical slope to the first conical slope is in the range of 0.7 to 1 and 0.3 to 1;

wherein the first and second frustoconical sections meet at a hinge line having a bend radius of less than 1 inch and a plurality of effusion cooling holes are provided in the outer liner at the hinge line; and wherein the second frustoconical section comprises two portions of substantially identical conical slope and a butt weld interposed between and joining said two portions, the butt weld being adjacent the hinge line and a plurality of effusion cooling holes being provided through the butt weld.

7. A gas turbine engine according to claim 6 wherein the first and second frustoconical sections meet angularly at a line adjacent an exit of at least one diffuser pipe of the engine.

8. A gas turbine engine according to claim 7 wherein the conical slopes of the first and second frustoconical sections are selected to provide a desired clearance between the at least one diffuser pipe exit.

9. A gas turbine engine according to claim 6 wherein the first frustoconical section includes a plurality of dilution holes.

10. A gas turbine engine according to claim 6, wherein the holes through the hinge line location are angled relative to a surface of the liner in which the holes are provided.

* * * * *